United States Patent [19]

Hagemes

[11] Patent Number: 4,752,057

[45] Date of Patent: Jun. 21, 1988

[54] STEEL TUBE PROP WITH RAPID RELEASE

[75] Inventor: Klaus Hagemes, Viersen, Fed. Rep. of Germany

[73] Assignee: Hunnebeck GmbH, Lintorf, Fed. Rep. of Germany

[21] Appl. No.: 38,214

[22] Filed: Apr. 14, 1987

[30] Foreign Application Priority Data

Apr. 18, 1986 [DE] Fed. Rep. of Germany ..... 3613075

[51] Int. Cl.[4] ..... E04G 25/06

[52] U.S. Cl. ..... 248/354.5; 248/354.3

[58] Field of Search ..... 248/354.3, 354.4, 354.5, 248/407, 423; 52/127.2; 403/108, 324

[56] References Cited

U.S. PATENT DOCUMENTS

| | | | |
|---|---|---|---|
| 1,505,443 | 8/1924 | Stone | 248/407 X |
| 2,504,291 | 4/1950 | Alderfer | 248/354.3 X |
| 2,617,620 | 11/1952 | Jessop | 248/354.3 X |
| 2,714,498 | 8/1955 | Wuthrich | 248/354.3 |
| 4,042,202 | 8/1977 | Molinari | 248/354.5 X |

FOREIGN PATENT DOCUMENTS

| | | | |
|---|---|---|---|
| 1139841 | 7/1957 | France | 248/354.3 |
| 643898 | 8/1952 | Italy | 248/354.3 |
| 266592 | 2/1950 | Switzerland | 248/407 |
| 408382 | 9/1966 | Switzerland | 248/354.3 |

*Primary Examiner*—Ramon S. Britts
*Assistant Examiner*—Karen J. Chotkowski
*Attorney, Agent, or Firm*—Merchant, Gould, Smith, Edell, Welter & Schmidt

[57] ABSTRACT

There is disclosed a steel tube prop for ceiling formwork with two telescopically interengaging tubes of which the outer one has a screw thread on its interengaging end and in the region of the thread contains an elongated hole passing through it radially and extending in the direction of the longitudinal axis of the support, through which hole can be inserted a pin which also passes through a hole in the inner tube, the pin being capable of being supported on a threaded sleeve which is screwed onto the thread of the outer tube. The pin has two engaging surfaces for the inner tube at different radial distances from its axis or in different planes and spaced apart by an amount determined by the diameter of the inner tube so that the inner tube can be lowered from a normal operative position into another position in a simple manner, for example, by a hammer blow on the pin.

10 Claims, 1 Drawing Sheet

STEEL TUBE PROP WITH RAPID RELEASE

Figure 1:
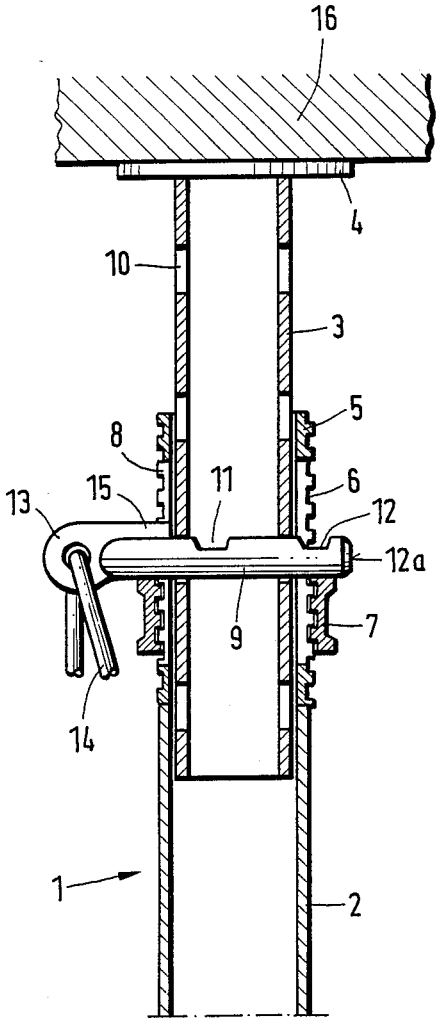

The invention relates to a steel tube prop for ceiling formwork or the like comprising two mutually telescoping tubes of which the outer one has a screw thread on its interengaging end, an elongated hole being provided in the region of the screw thread and extending in the direction of the longitudinal axis of the prop and traversing it radially, through which, and simultaneously through a hole provided in the inserted tube, there passes a pin which can abut against a screw-threaded sleeve screwed onto the thread on the outer tube.

Steel tube props of this kind are widely used, in particular in concrete construction for formwork for ceilings. In this connection it is known (DE-GM No. 8421204), for the purpose of so-called rapid release, to arrange a freely rotatable bush between the threaded sleeve and the pin which passes through both tubes, that end of the bush which faces the pin being arranged in the form of a cam surface with engagement surfaces of different heights, on which rest the two ends of the pin that project from the prop. On initial erection and during the casting the pin engages the higher of the two surfaces. When the time comes for the head end of the prop to be released for lowering the structure away from the formwork then, in order to be able to slacken the threaded sleeve back without undue effort, the bush is turned through about 90° so that the pin can drop suddenly onto the lower of the supporting surfaces and accordingly the head of the prop comes clear of the formwork.

It has been found that when the prop is being set up by rotating the screw-threaded sleeve, the bush which rests on it can inadvertently become rotated so that the rapid release action takes place before the final assembly and the prop is set up, if erected carelessly, with the head already lowered. In this event it is then no longer possible to effect the rapid release when the time comes for disassembly. Moreover the freely rotatably bush which is provided with the cam surfaces represent an additional component which not only gives rise to extra cost, but also increases the weight of the prop. Finally it has also turned out to be a drawback that the bush provided for this kind of rapid release cannot be subsequently fitted to already existing telescopic steel tube props because according to new regulations the two tubes of a steel tube prop must be connected together non-releasably, i.e. they cannot be taken apart, so the bush can no longer be fitted at a later date.

The object of the invention is to simplify the rapid release and at the same time provide the possibility of also equipping already-assembled steel tube props with a simple and economical rapid lowering facility.

This problem is solved according to the invention in that the pin which is inserted through the aligned holes in the telescopically interengaging tubes of the prop and which is supported on the screw-threaded sleeve has two engaging surfaces for the inner tube at different radial distances from its own longitudinal axis and mutually spaced apart, on which surfaces the inner tube can alternately engage according to which position of the inner tube is desired. In contrast to the known prop with rapid release, in the arrangement according to the present invention no additional component is required to provide the rapid release. On the contrary, all that is necessary is a modification to the inserted pin, so no additional component is required for rapid release and furthermore already-existing steel tube props can be fitted with the rapid release facility according to the invention without any difficulty because for this purpose all that is necessary is to replace the pin.

Preferably the pin fitted for rapid release has two notches situated between its ends and spaced apart by a distance equal to the diameter of the inserted tube, the notches being at least as wide as the wall thickness of that tube. The notches could for example be arranged eccentrically with respect to the longitudinal axis of the pin. These notches can be produced easily and economically and they serve as one of the two engaging surfaces for the one tube of the prop, whilst the peripheral surface or outer surface of the pin forms the other engaging surface.

In order to simplify the movement or axial displacement of the pin necessary for rapid release, the pin can have lightly inclined ramp surfaces leading into the notches. By means of a blow with a hammer on the end of the pin that projects from the support the pin can be shifted without difficulty from the operative position to the desired position for rapid release.

According to a further feature of the invention the pin has on one end a stop which limits the depth of penetration, for example a nose bearing against the external surface of the screw-threaded sleeve. In this way the result is achieved that the position needed for the normal operation is set accurately even though the actual engaging regions, which are within the prop, are not visible in practice from outside.

As the screw-threaded sleeve is turned to set the desired operative position of the head of the prop,- whereas the inserted pin is only able to move axially, the rotation of sleeve cannot cause the pin to become adjusted in any unwanted manner. Accordingly the erection of the prop equipped with the rapid release arrangement according to the invention is simplified. To this must be added the fact that no additional components are required for rapid release, such as would give rise to cost and would increase the weight of the prop.

Figure 2:
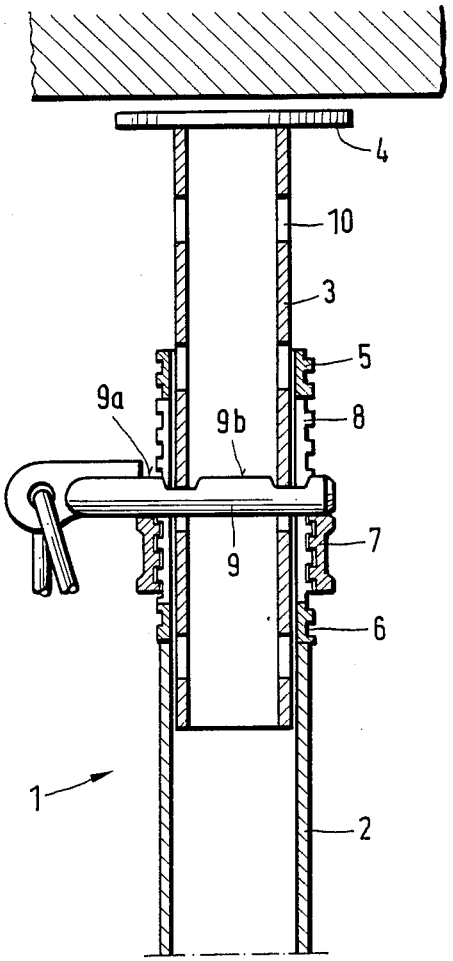

An embodiment of a steel tube prop with rapid release arrangements according to the invention is illustrated by way of example in the drawing, in which:

FIG. 1 is a longitudinal section through an externally threaded steel tube prop in the operative position, and FIG. 2 is a longitudinal section through the prop of FIG. 1 but with the inner tube lowered so that the head plate is released from the formwork which it had been supporting.

A steel tube prop 1, of which only the upper part is illustrated in the drawing, comprises an outer tube 2 and an inner tube 3 which is inserted in it and can move in and out of it telescopically and is provided on its outer end with a head plate 4. This prop could however equally well be used in the inverted position, that is to say with the plate 4 in the form of a foot resting on the floor while a similar plate mounted on the outer end of the tube 2, but not shown in the drawing, serves as the head plate.

On that end of the tube 2 which is uppermost in the drawing there is secured a tubular extension 5 with an external screw thread 6 onto which is screwed a threaded sleeve 7. The extension 5 contains an elongated hole 8 extending in the direction of the longitudinal axis of the prop 1, through which can be inserted a pin 9 which rests on the sleeve 7.

The inner tube 3 is provided with number of axially spaced holes 10 extending radially and spaced apart from one another axially, through which the pin 9 can be inserted. To insert the pin 9 one of the holes 10 in the inner tube 3 is brought within the span of the elongated hole 8 and then the pin is inserted. The screw-threaded sleeve 7 is then rotated on the thread 6 until the plate 4 arrives at the desired height.

The pin 9 has on one side of it two notches 11 and 12 which are spaced apart from one another by a distance corresponding to the diameter of the inner tube 3 and are of a width corresponding to the wall thickness of the tube 3. The notches 11 and 12 are arranged offset or eccentrically with respect to the pin 9 in the example illustrated.

At the rear end of the pin 9 there is an eye 13 through which is inserted a wire ring 14 which passes around the tube 2 in order to connect the pin 9 permanently to the prop 1 and to prevent the pin being inserted upside down, namely with the notches 11 and 12 facing the sleeve 7.

The eye 13 is provided with an extension in the form of a nose 15 which extends along the length of the pin 9 on the outside of it and forms a stop which limits the depth of penetration of the pin 9.

As shown in FIG. 1, the nose 15 engages the inner tube 3 when the pin 9 is inserted to its normal operative position, in which the inner tube 3 engages the portions 9*a* and 9*b* of the pin adjacent to the notches 11 and 12. These portions 9*a* and 9*b* could be lightly inclined towards the adjacent notch 11 or 12 in order to ease the sliding movement between the pin 9 and the tube 3 which rests on it, necessary for lowering the inner tube 3.

In order to bring the prop 1 from the position shown in FIG. 1, in which the plate 4 engages hard against the underside of formwork 16 or another component which is to be supported, into the position illustrated in FIG. 2 in which the tube 3 has been lowered and the plate 4 is accordingly spaced away from the formwork or the like, the pin 9 is displaced far enough to the left so that the inner tube 3 is aligned with the region of the notches 11 and 12. For this purpose, for example, the right-hand end 12*a* as viewed in the drawing, of the pin 9 is struck with a hammer. In particular when the portions 9*a* and 9*b* are lightly inclined, a single blow of a hammer is sufficient to displace the pin from the position shown in FIG. 1 to that shown in FIG. 2. In this way a simple and rapid lowering and rapid dismantling of the prop 1 is achieved.

The notches 11 and 12 do not need to be particularly deep and so they scarcely weaken the supporting cross section of the pin because for rapid lowering it is sufficient merely to relieve the pressure acting through the plate 4 on the sleeve 7. To dismantle the prop 1 the sleeve 7 is screwed back, and this is possible without exerting any undue effort, as soon as the supporting load is released.

In the embodiment illustrated the notches 11 and 12 are arranged eccentrically, i.e. offset. The nose 15 which forms the stop is arranged on the outside of the pin 9 opposite the notches 11 and 12 so that when inserting the pin one only has to watch out that the nose 15 is uppermost in order to ensure that when the pin 9 is knocked back the desired lowering is achieved. This uppermost position is achieved when the nose, as shown in FIG. 1, is able to project into the elongated hole 8 in the outer tube 2.

As the notches 11 and 12 do not significantly weaken the supporting cross section of the pin 9 one can also fit such pins to already-existing props because their overall diameter does not need to be increased over that of the pins used hitcherto and the pin 9 accordingly fits also the holes in the inner tube 3 and the elongated hole in the outer tube 2 of existing props.

I claim:

1. A prop-type support, comprising:

(a) telescopically interengaging inner and outer tubes;

(b) an external screw thread on said outer tube;

(c) an axially elongated slot traversing the outer tube in the region of the screw thread;

(d) a series of axially spaced holes traversing the inner tube;

(e) an internally screw threaded sleeve, the sleeve being received on the screw thread; and (f) a support pin traversing the slot and a selected one of the holes, the support pin having a longitudinal axis, the sleeve bearing against the pin to maintain the tubes in a required relative spacing against an end load, the pin including first and second engaging surfaces for engaging a wall of the inner tube, each of the engaging surfaces being, at a first radial spacing and a second, different radial spacing, respectively, from the longitudinal axis of the support pin, such that a the pin being in a first position with the inner tube bearing against the first engaging surface which is at a greater radial spacing from the longitudinal axis of the pin than is the second engaging surface, rapidly lowered by an amount equal to the difference between the first radial spacing and the second radial spacing of the first and second engaging surfaces of the support pin. of substantial axial extend so as to serve as a bearing surface and being

2. The support set forth in claim 1 wherein said first surface comprises the external surface of said pin and said second surface comprises the base of a notch in said pin.

3. The support set forth in claim 1 wherein there are two of each of said first and second surfaces, spaced apart along said pin by a distance determined by the diameter of said inner tube.

4. The support set forth in claim 3 wherein said second surfaces are offset asymmetrically along the length of said pin.

5. The support set forth in claim 1 including stop means defining the axial position of said pin in said slot and hole.

6. The support set forth in claim 5 wherein said stop means comprise a nose extending parallel to said pin and engageable in said slot.

7. The support set forth in claim 5 wherein said nose lies on the same side of said pin as said second surface.

8. The support set forth in claim 2 wherein there are two of each of said first and second surfaces, spaced apart along said pin by a distance determined by the diameter of said inner tube.

9. The support set forth in claim 6 wherein said nose lies on the same side of said pin as said second surface.

10. The support set forth in claim 8 wherein said second surfaces are offset asymmetrically along the length of said pin.

* * * * *